US007763118B2

(12) United States Patent
Pyo et al.

(10) Patent No.: US 7,763,118 B2
(45) Date of Patent: Jul. 27, 2010

(54) DISHWASHER

(75) Inventors: Joon Ho Pyo, Seoul (KR); Sang Heon Yoon, Gwangmyung-si (KR); Tae Hee Lee, Boocheon-si (KR)

(73) Assignee: LG Electronics Inc., Seoul (KR)

( * ) Notice: Subject to any disclaimer, the term of this patent is extended or adjusted under 35 U.S.C. 154(b) by 78 days.

(21) Appl. No.: 11/703,832

(22) Filed: Feb. 8, 2007

(65) Prior Publication Data

US 2008/0000506 A1 Jan. 3, 2008

(30) Foreign Application Priority Data

Jun. 19, 2006 (KR) ..... 10-2006-0054754

(51) Int. Cl.
*B08B 3/00* (2006.01)

(52) U.S. Cl. ..... 134/56 D; 134/57 D; 134/58 D; 134/98.1; 134/99.1; 134/102.1; 134/103.1; 134/108; 134/111

(58) Field of Classification Search ..... 134/57 D, 134/56 D, 58 D, 98.1, 99.1, 102.1, 103.1, 134/108, 111
See application file for complete search history.

(56) References Cited

U.S. PATENT DOCUMENTS 3,559,886 A * 2/1971 Howard ..... 239/136
5,423,485 A * 6/1995 Tagusari ..... 239/121
2004/0187898 A1* 9/2004 Chen ..... 134/58 D
2005/0236019 A1* 10/2005 Bang ..... 134/56 D
2005/0284505 A1* 12/2005 Bang ..... 134/56 D
2006/0277690 A1* 12/2006 Pyo et al. ..... 8/149.2
2007/0102026 A1* 5/2007 Ahn et al. ..... 134/25.2

FOREIGN PATENT DOCUMENTS

GB 2155316 * 9/1985
WO WO2006037447 * 4/2006

OTHER PUBLICATIONS

Machine translation of WO 2006/037447 (published Apr. 2006).*

* cited by examiner

*Primary Examiner*—Michael Cleveland
*Assistant Examiner*—Samuel A Waldbaum
(74) *Attorney, Agent, or Firm*—McKenna Long & Aldridge LLP

(57) ABSTRACT

A dishwasher includes a tub, a steam generator for generating steam, a water supply passage for supplying washing water to the steam generator, a release valve having a steam passage along which the steam generated by the steam generator is supplied to the tub, and a condensed water passage connected to the water supply passage to allow water condensed by the steam to fall to the water supply passage.

17 Claims, 4 Drawing Sheets

DISHWASHER

This application claims the benefit of Korean Patent Application No. 10-2006-0054754, filed on Jun. 19, 2006, which is hereby incorporated by reference for all purposes as if fully set forth herein.

BACKGROUND OF THE INVENTION

1. Field of the Invention

The present invention relates to a dishwasher and, more particularly, to a dishwasher that reduces noise that is generated when steam and condensed water collide in a steam passage.

2. Description of the Related Art

Generally, a dishwasher includes a rack disposed within a tub where dishes are arranged on the rack, a spray nozzle for spraying washing water toward the dishes arranged on the rack, and a sump for accumulating the washing water.

During the washing cycle, the washing water accumulated in the sump is directed to the spray nozzle by a washing pump and washing motor. The washing water sprayed through the spray nozzle collides with surfaces of the dishes. Dirt is removed from the dishes due to the pressure of the washing water.

Various methods have been contemplated to improve the washing efficiency of the dishwasher, including heating the washing water and adding a pre-wash step to the washing cycle.

When the washing water is heated, the detergent is more readily dissolved and any dirt adhered to the dishes is more easily removed.

In a pre-wash step, moisture is introduced to the tub prior to washing and any dirt adhered to the dishes is re-hydrated, allowing the dirt to be more easily removed. Ultraviolet rays may also be emitted during the pre-wash step to stop the spread of bacteria.

The moisture supplied during the pre-wash step may be in various forms, including steam. When steam is supplied during the pre-wash cycle, a steam generator is connected to the tub through a steam passage. As the steam travels from the steam generator to the tub, some of the steam condenses back to water prior to reaching the tub. This condensed water returns to the steam generator through the steam passage and collides with the steam discharged from the steam generator. This collision restricts the flow of steam to the tub and also generated undesired noise.

SUMMARY

Accordingly, a dishwasher that substantially obviates one or more problems due to limitations and disadvantages of the related art is highly desirable.

An advantage of the present invention is to provide a dishwasher that improves steam washing efficiency by preventing condensed water from colliding with steam flowing through a steam passage.

Another advantage of the present invention is to provide a dishwasher that reduces unwanted noise by improving the structure of a steam passage.

Additional features and advantages of the invention will be set forth in part in the description which follows, and in part will become apparent from the description, or may be learned by practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dishwasher comprising: a tub; at least one rack positioned within the tub, wherein the rack is configured to support dishes; a steam generator that generates steam; a steam passage that supplies the steam generated by the steam generator to the tub; and a condensed water passage that discharges water condensed from the steam out of the steam passage.

In another aspect of the present invention, there is provided a dishwasher comprising: a tub; at least one rack positioned within the tub, wherein the rack is configured to support dishes, a steam generator that generates steam; a water supply passage that supplies washing water to the steam generator; a safety valve having a steam passage from which the steam generated by the steam generator is supplied to the tub; and a condensed water passage connected to the water supply passage that allows water condensed from the steam to be re-supplied to the water supply passage.

In still another aspect of the present invention, there is provided a dishwasher comprising: a tub defining a dish washing chamber; a steam generator that generates steam; a steam passage connecting the steam generator to the tub; and a condensed water passage branched from the steam passage and structured to prevent the condensed water from collecting in the steam passage.

It is to be understood that both the foregoing general description and the following detailed description are exemplary and explanatory and should not be construed as limiting the scope of the claims.

BRIEF DESCRIPTION OF THE DRAWINGS

The accompanying drawings, which are included to provide a further understanding of the invention and are incorporated in and constitute a part of this application, illustrate embodiments of the invention and together with the description, serve to explain the principle of the invention.

In the drawings.

DETAILED DESCRIPTION OF THE ILLUSTRATED EMBODIMENTS

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
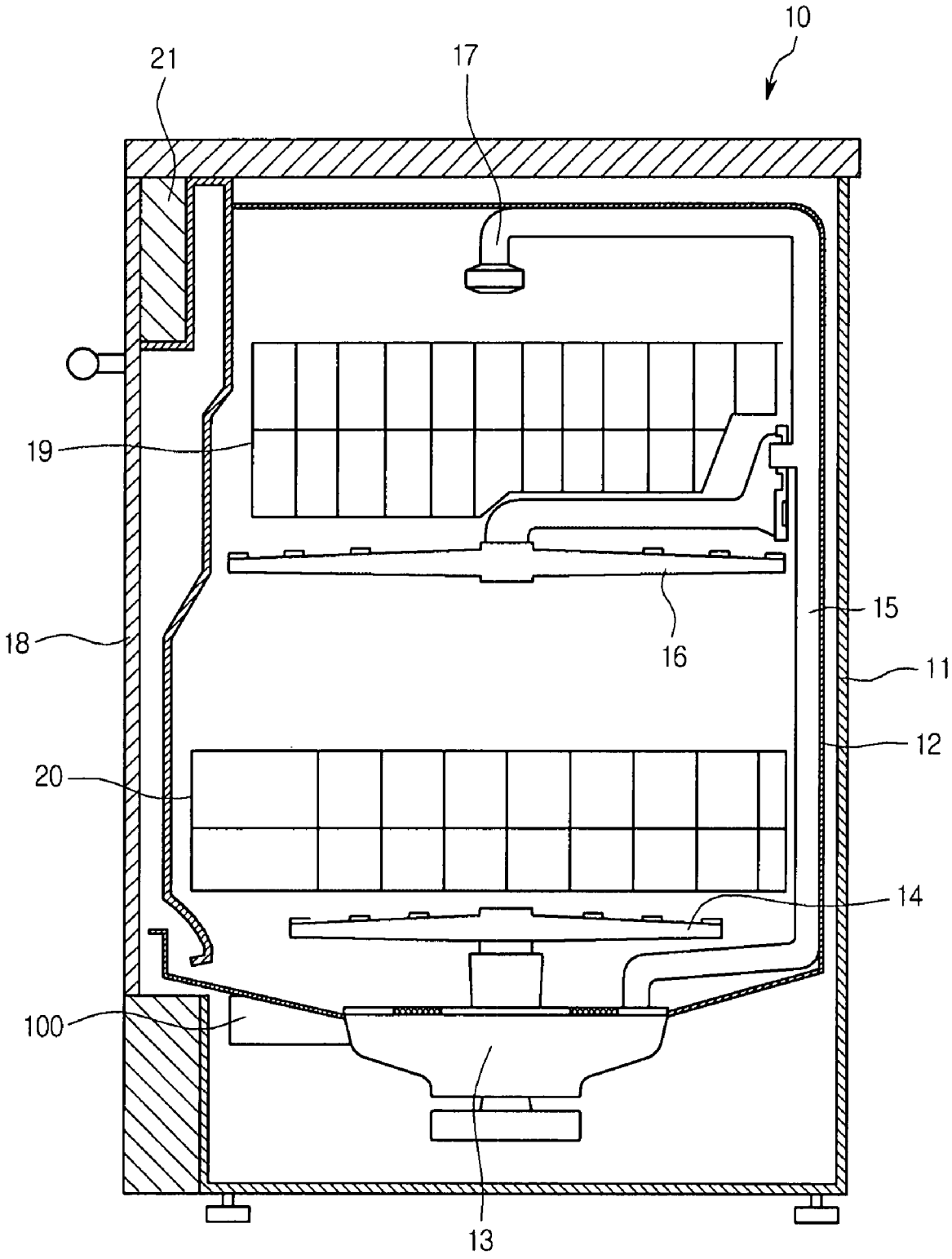
FIG. 1 is a sectional view of a dishwasher according to an embodiment of the present invention.

Referring to FIG. 1, a dishwasher 10 includes a cabinet 11, a tub 12 defining a washing chamber, a door 18 provided at a front portion of the cabinet 11 to access the washing chamber, a control panel 21 provided on a top surface of the door 18, upper and lower racks 19 and 20 detachably mounted within the tub 12 for receiving dishes, a sump 13 provided on a bottom of the tub 12 to accumulate washing water, a lower nozzle 14 positioned and centered above the sump 13 for spraying washing water, a water guide 15 connected to a top-periphery of the sump 13 to guide the washing water upward, an upper nozzle 16 branched off from the water guide 15 for spraying washing water downward, a top nozzle 17 provided on an end of the water guide 15 for spraying washing water downward from a higher position in the tub than the upper nozzle 16, and a steam generator 100 coupled with the sump 13 to store water used during the generation of steam.

Figure 2:
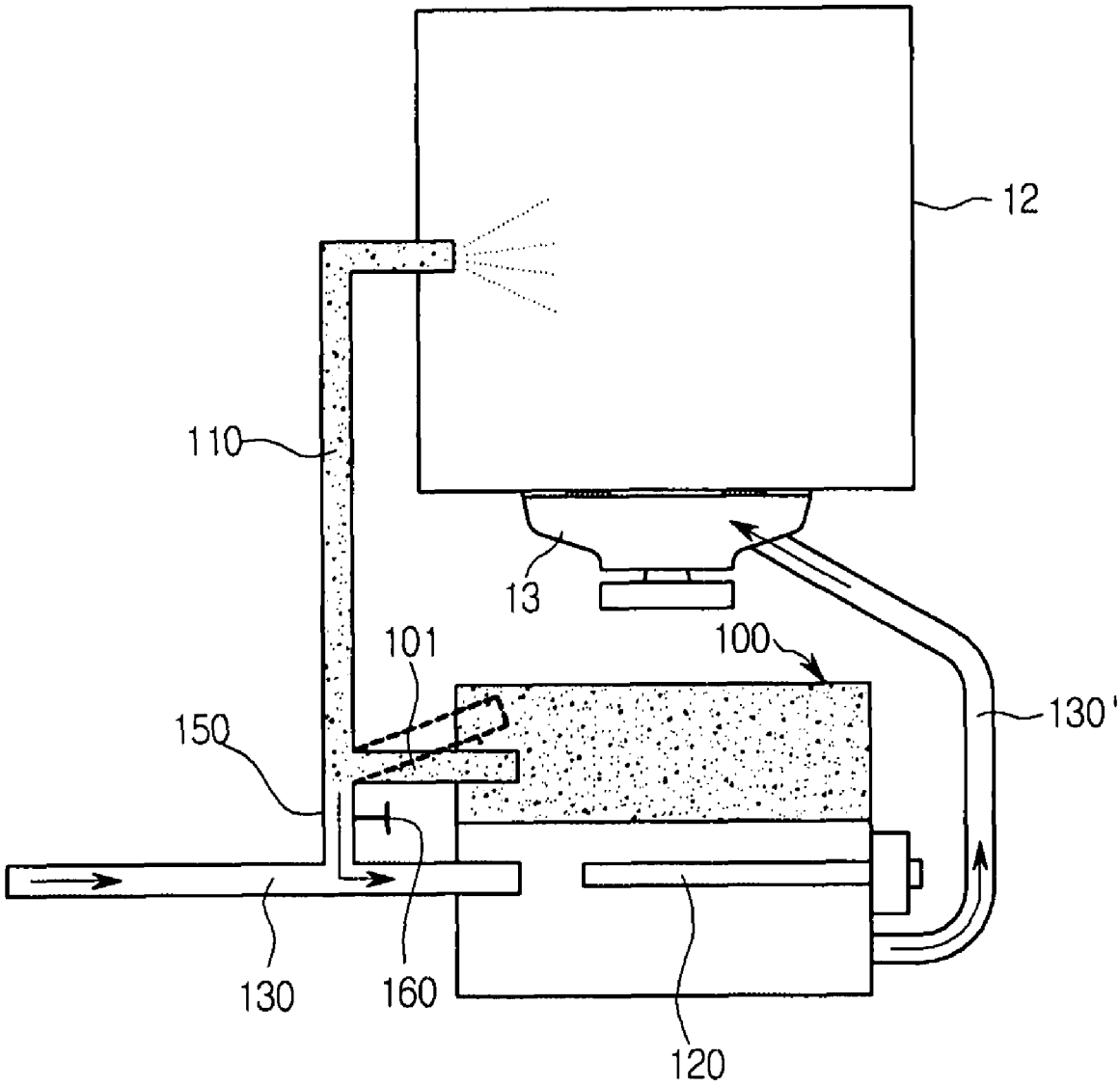
FIG. 2 is a schematic view of a steam generation structure of a dishwasher according to an embodiment of the present invention.

Referring to FIG. 2, one end of a water supply passage 130 is connected to a water source, a second end of the water supply passage 130 is connected to a side of the steam generator 100, and a connection pipe 130' has a first end connected to the steam generator 100 and a second end connected to the sump. The washing water, supplied from the water source, is supplied to the sump 13 via the steam generator 100. When the water level in the sump 13 reaches a predetermined level, the supply of washing water from the water source is stopped, leaving a predetermined amount of washing water within the steam generator 100.

An operation of the dishwasher 10 will now be described.

The door 18 is opened and upper rack 19 and/or lower rack 20 are withdrawn from the tub 12. Dishes are arranged on the racks 19 and 20, the racks are returned to their original positions in the tub 12 and the door 18 is closed. Detergent or rinse may be supplied to a dispensing container before the door 18 is closed.

Then, a desired washing mode is entered through a selector provided on the control panel 21 and dishwasher proceeds to wash the dishes.

The washing water in the sump 13 is pumped through water guide 15 by a washing pump provided in the sump 13 and is then directed to nozzles 14, 16 and 17. The nozzles 14, 16, 17 spray the washing water into the tub 12 and the water collides with the surfaces of the dishes. The washing water and the dirt removed by the washing water fall to the bottom of the tub 12 and accumulate in the sump 13.

The washing cycle may include various steps. An example of some of these steps is describe below. One step may be a pre-wash step. During the pre-wash step, steam is supplied to the tub 12 and any dirt that has adhered to the dishes is re-hydrated by the steam allowing the dirt to be more easily removed from the dishes. Another step may be a main washing step. Detergent or rinse may be mixed with the washing water during the main washing step. Then the washing water is sprayed onto the dishes in the racks to remove any of the dirt present on the dishes. A rinsing step may also be included. Any remaining dirt or washing water is rinsed away during the rinse step. A drying step may also be performed, to remove any excess water from the dishes. All of the above steps may be performed sequentially or only selected steps may performed.

Steam may be supplied to the tub 12 during any of the above-described steps. That is, the steam may be supplied during the main washing steps, the rinsing steps and the drying steps as well as the pre-wash steps, depending on the washing condition selected to be performed.

Referring to FIG. 2, washing water is supplied to the sump 13 from a water source via the steam generator 100. The washing water is supplied to the steam generator 100 through a water supply passage 130 and the washing water is supplied to the sump 13 through a connection pipe 130' coupled with the steam generator 100. When the water level in the sump 13 reaches a predetermined level, the supply of washing water is stopped and a predetermined amount of washing water is present in the steam generator.

When the steam function is selected, the heater 120 in the steam generator 100 heats the washing water to a temperature high enough to evaporate the washing water into steam.

Steam generated in the steam generator 100 is distributed at an inner-upper portion of the steam generator 100. The steam passes through the steam discharge portion 101 to the steam passage 110 to be supplied to the tub 12.

Steam generated by the steam generator 100 flows into to the tub 12 through a steam discharge portion 101 and a steam passage 110. A condensed water passage 150 is connected to the water supply passage 130 and may be positioned such that any condensed water that forms in the steam passage 110 is re-supplied to the water supply passage. The steam discharge portion 101 may be oriented in various ways, including but not limited to, a gradual incline toward the steam passage 110, as shown by the dotted outline in FIG. 2, or horizontal to the steam passage 110, as shown by the solid outline in FIG. 2. The steam discharge portion 101 may be integrally formed with the steam passage 110 or it may be formed separately.

However, all of the steam that is generated may not reach the tub 12. When the temperature of the steam is sufficiently reduced between the steam generator 100 and the tub 12, the steam condenses back to water, thereby forming condensed water. The condensed water passes through the steam passage 110 and is collected in a condensed water passage 150. The condensed water passage 150 may extend in various directions, including a direction parallel to the steam passage 110. A portion of the condensed water may be re-supplied to the steam generator 100 through the water supply passage 130 and a flow valve 160 may be installed on the condensed water passage 150 to control the flow of the condensed water re-supplied to the water supply passage 130.

A diameter of the condensed water passage 150 may be selected such that the washing water supplied to the steam generator 100 is prevented from flowing into the condensed water passage 150. For example, the diameter of the condensed water passage 150 may be less than the diameter of the water supply passage 130.

In addition, the steam discharge portion 101 may be positioned such that the direction in which the steam passes through the steam discharge portion 101 is different from a direction in which the steam passes through the steam passage 110 in order to prevent any condensed water in the steam passage 110 from being introduced into the steam discharge portion 101.

The present invention is not limited to a steam passage 110 connected to the tub 12, as discussed above. In an alternative embodiment, the steam may be supplied to the tub through, for example, a release valve which will now be described in more detail.

Figure 3:
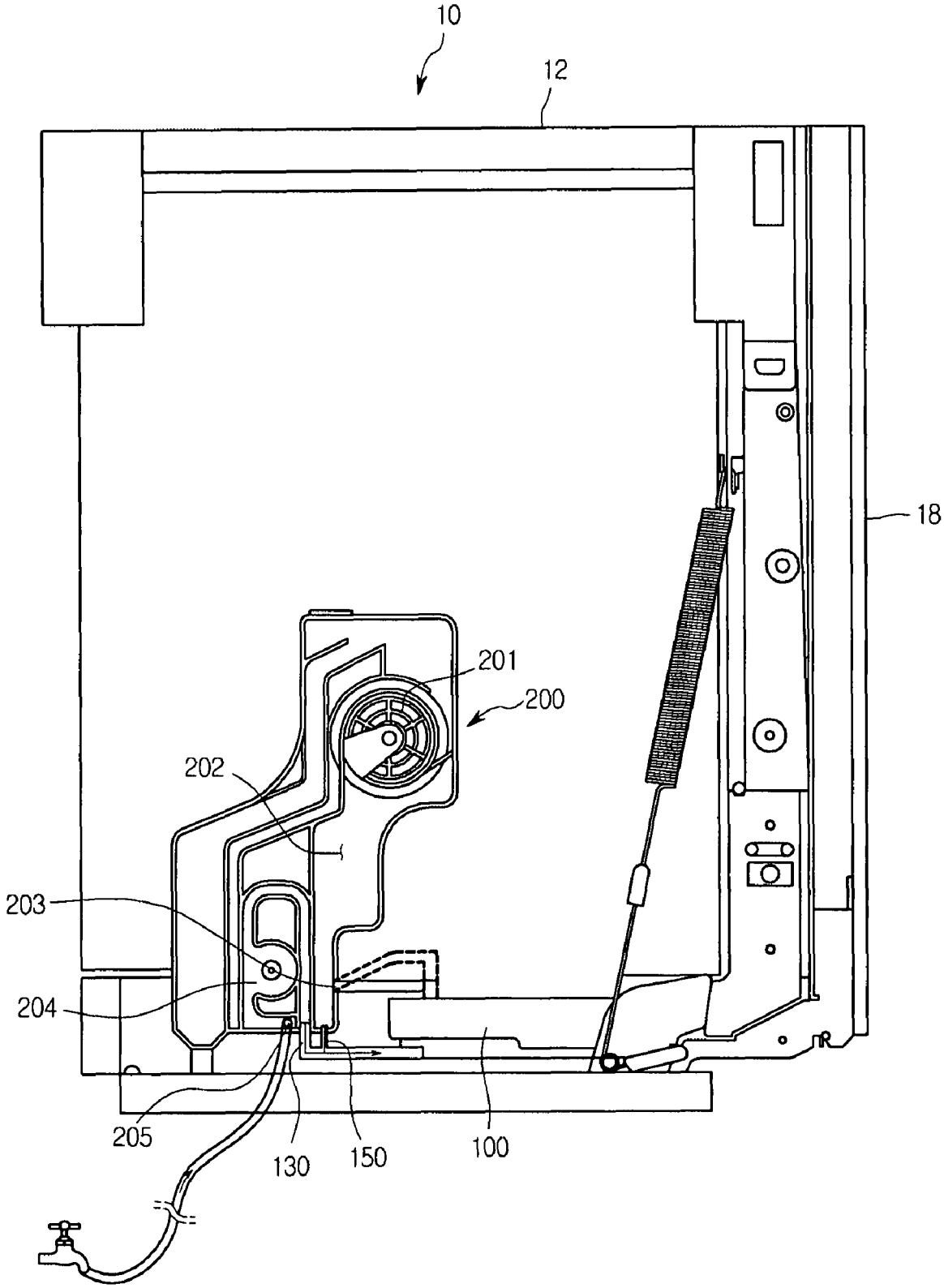
FIG. 3 is a side view of a dishwasher according to another embodiment of the present invention.
Figure 4:
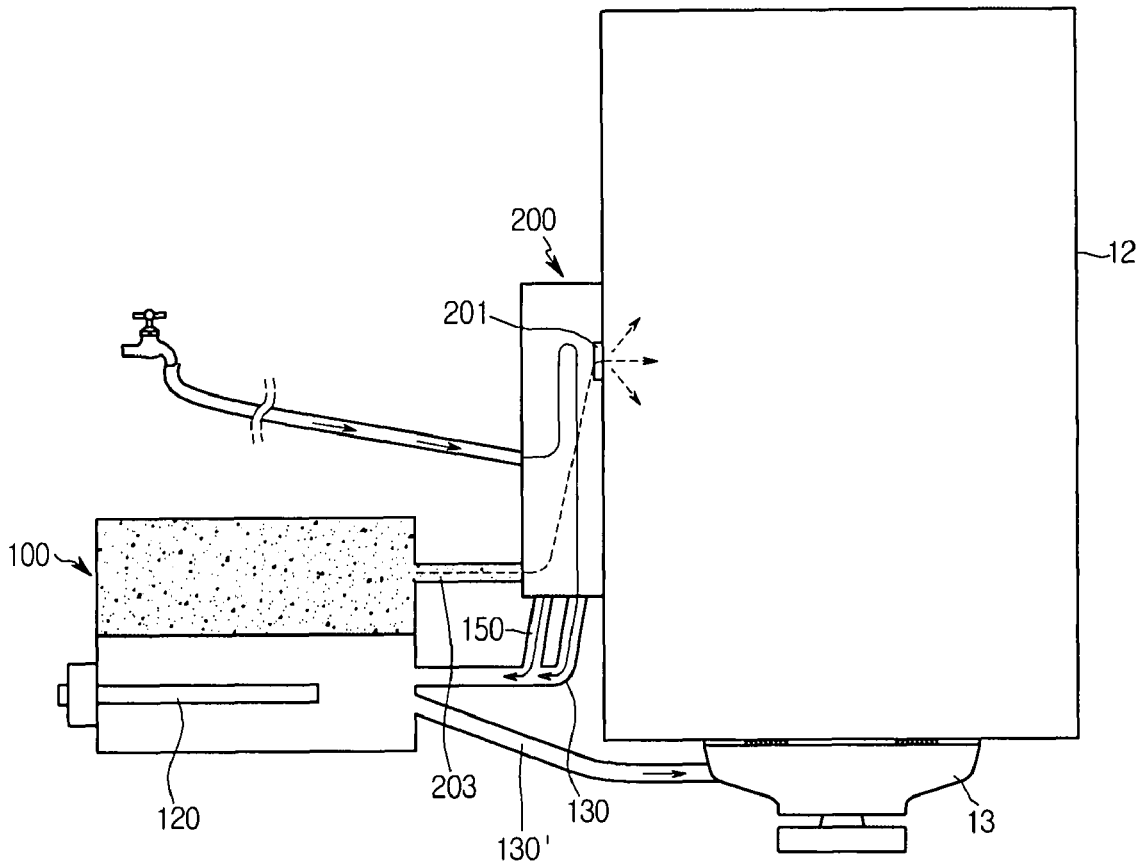
FIG. 4 is a front view of a dishwasher according the embodiment shown in FIG. 3.

Referring to FIGS. 3 and 4, a release valve 200 is provided at a side of the dishwasher 10. During a main washing step, the temperature and pressure within the tub 12 are significantly high. For example, the air within the tub 12 may reach temperatures in excess of at least 80 degrees Celsius. As the temperature of the air within the tub 12 increases, so does the pressure. The release valve 200 safely controls the pressure within the tub to prevent damage to the dishwasher by removing the high temperature, high pressure air from the tub 12 through communication hole 201.

In this embodiment, the release valve 200 is connected to the tub 12 and the steam generated by the steam generator 100 passes through the release valve 200 and is then directed to the tub 12 through the communication hole 201. Washing water is supplied to the dishwasher from a water source through a water supply hole 205 formed in the release valve 200 and the amount of washing water passing through the water supply hole 205 is measured by a flow meter 204. A steam passage 202 is formed in the release valve 200 and the steam generated by the steam generator 100 flows into the tub 12 through the steam passage 202.

The communication hole 201 may be provided at an upper side of the steam passage 202 to allow the steam flowing through the steam passage 202 to be directed into the tub 12. A steam discharge portion 203 may extend from a side of the steam generator 100 and connect to the release valve 200. More specifically, the steam discharge portion 203 communicates with the steam passage 202 formed in the release valve 200.

In addition, the release valve 200 and the steam generator 100 may communicate with each other through the water supply passage 130. The washing water passing through the flow meter 204 is directed to the steam generator 100 along the water supply passage 130 and the sump 13 along the connection pipe 130'. A condensed water passage 150 extends from a lower end of the steam passage 202 and may be connected to the water supply passage 130. Therefore, any condensed water formed within the steam passage 202 may be returned to the steam generator 100 through the condensed water passage 150 and the water supply passage 130.

Like the foregoing embodiment, steam passes through the steam discharge portion 203 in a direction that is different from a direction in which steam passes through the steam passage 202 to prevent condensed water from being introduced into the steam discharge portion 203. As shown in FIG. 3, at least a portion of the steam discharge portion 203 may be orientated with an incline, as shown by the dotted outline, or the steam discharge portion 203 may be orientated horizontally, as shown by the solid outline. In addition, a diameter of the condensed water passage 150 may be less than that of the water supply passage 130.

An inlet of the condensed water passage 150, which is connected to the release valve 200, may be formed at a portion of the steam passage 202 where condensed water collects.

It will be apparent to those skilled in the art that various modifications and variations can be made without departing from the spirit or scope of the invention. Thus, it is intended that those modifications and variations are covered if they come within the scope of the appended claims and their equivalents.

What is claimed is:

1. A dishwasher comprising;

a tub;

a sump installed at a bottom of the tub to supply water for washing dishes;

at least one rack positioned within the tub, wherein the rack is configured to receive dishes;

a steam generator that generates steam, the steam generator configured to supply water to the sump and supply steam to the tub through separate passages, where the separate passages comprise:

a connection pipe that fluidly connects the steam generator and the sump, to supply the water to the sump; and a steam passage that supplies the steam generated by the steam generator to the tub;

a water supply passage which connects a water source outside the dishwasher to the steam generator; and a condensed water passage that fluidly connects the steam passage and the water supply passage, the condensed water in the steam passage returning to the steam generator by sequentially passing through the condensed water passage and the water supply passage.

2. The dishwasher according to claim 1, wherein one end of the condensed water passage is extended from the steam passage to form an integral flow passage and the other end of the condensed water passage is fluidly connected to the water supply passage.

3. The dishwasher according to claim 2, wherein a diameter of the water supply passage is greater than that of the condensed water passage.

4. The dishwasher according to claim 2, wherein the condensed water passage is extended from a lower end of the steam passage.

5. The dishwasher according to claim 4, wherein the condensed water passage extends in a direction parallel to the steam passage.

6. The dishwasher according to claim 1, further comprising a steam discharge portion, wherein the steam discharge portion is structured to connect a steam outlet of the steam generator at substantially the beginning of the steam passage, and wherein the proximal end of the steam discharge portion closest to the steam outlet is higher than the distal end of the steam discharge portion closest to the steam passage, in order to prevent condensed water formed in the steam passage from being introduced into the steam discharge portion.

7. The dishwasher according to claim 1, further comprising a tub pressure controlling unit, wherein the tub pressure controlling unit has therein:

at least a portion of the steam passage, the steam generated by the steam generator entering the tub through the portion of the steam passage; and at least a portion of the water supply passage, which is separately provided from the portion of the steam passage within the tub pressure controlling unit.

8. The dishwasher according to claim 7, wherein an inlet of the condensed water passage is located at a point where the condensed water is collected in the steam passage.

9. The dishwasher according to claim 1, further comprising a valve for opening and closing the condensed water passage.

10. A dishwasher comprising:

a tub;

a sump installed at a bottom of the tub to supply water for washing dishes;

at least one rack positioned within the tub, wherein the rack is configured to receive dishes;

a steam generator that generates steam;

a water supply passage which connects a water source outside the dishwasher to the steam generator;

a connecting passage connecting the steam generator and the sump, to supply water into the sump;

a tub pressure controlling unit provided to control the pressure in the tub, the tub pressure controlling unit having a steam passage, wherein the steam generated by the steam generator is introduced into the tub through the steam passage; and a condensed water passage extended from the pressure controlling unit to the water supply passage such that the condensed water in the steam passage flows back to the steam generator through the condensed water passage, wherein the water supply passage passes through the tub pressure controlling unit and reaches to the steam generator.

11. The dishwasher according to claim 10, further comprising a steam discharge portion connecting the steam passage to an outlet of the steam generator.

12. The dishwasher according to claim 11, wherein at least a portion of the steam discharge portion is inclined.

13. The dishwasher according to claim 12, wherein an end of the steam discharge portion closest to the steam generator is at a higher position than an end of the steam discharge portion closest to the steam passage.

14. The dishwasher according to claim 12, wherein an end of the steam discharge portion connected to the steam passage is at a higher position than an end of the condensed water passage connected to the steam passage.

15. The dishwasher according to claim 12, wherein the steam discharge portion is inclined in such a way that at least a portion of the steam discharge portion is extended upwardly from the tub pressure controlling unit.

16. The dishwasher according to claim 11, wherein the steam discharge portion is connected to the tub pressure controlling unit at a location different from a location where the condensed water generated in the tub pressure controlling unit is collected.

17. The dishwasher according to claim 10, wherein the condensed water passage is connected to the tub pressure controlling unit at a location where the condensed water is collected.

* * * * *